US006766025B1

(12) United States Patent
Levy et al.

(10) Patent No.: US 6,766,025 B1
(45) Date of Patent: Jul. 20, 2004

(54) INTELLIGENT SPEAKER TRAINING USING MICROPHONE FEEDBACK AND PRE-LOADED TEMPLATES

(75) Inventors: Paul S. Levy, Chandler, AZ (US); D. C. Sessions, Phoenix, AZ (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/267,618

(22) Filed: Mar. 15, 1999

(51) Int. Cl.[7] ..... H04R 3/00
(52) U.S. Cl. ..... 381/96; 381/95; 381/56
(58) Field of Search ..... 381/96, 55, 56, 381/57, 58, 59, 95

(56) References Cited

U.S. PATENT DOCUMENTS 5,559,891 A * 9/1996 Kuusama ..... 381/63

* cited by examiner

*Primary Examiner*—Minsun Oh Harvey
(74) *Attorney, Agent, or Firm*—Michael J. Ure

(57) ABSTRACT

A programmable speaker uses characterization data stored within the memory of the speaker and digital signal processing (DSP) to digitally perform transform functions on input audio signals to compensate for speaker related distortion and listening environment distortion. In a manufacturing environment, a non-intrusive system and method for tuning the speaker is performed by applying a reference signal and a control signal to the input of the programmable speaker. A microphone detects an audible signal corresponding to the input reference signal at the output of the speaker and feeds it back to a tester which analyzes the frequency response of the speaker by comparing the input reference signal to the audible output signal from the speaker. Depending on the results of the comparison, the tester provides to the speaker an updated digital control signal with new characterization data which is then stored in the speaker memory and used to again perform transform functions on the input reference signal. The tuning feedback cycle continues until the input reference signal and the audible output signal from the speaker exhibit the desired frequency response as determined by the tester. In a consumer environment, a microphone is positioned within selected listening environments and the tuning device is again used to update the characterization data to compensate for distortion affects detected by the microphone within the selected listening environment.

9 Claims, 7 Drawing Sheets

INTELLIGENT SPEAKER TRAINING USING MICROPHONE FEEDBACK AND PRE-LOADED TEMPLATES

BACKGROUND OF THE INVENTION

1. Field of the Invention

The present invention relates to audio speakers, and more particularly to tuning speakers.

2. State of the Art

In the manufacturing process of speakers it is desirable to build a speaker system, having a uniform and predictable input/output (I/O) response characteristic or I/O transfer function. Ideally, the analog audio signal coupled to the input of a speaker is what is provided at the ear of the listener. In reality, the audio signal that reaches the listener's ear is the original audio signal plus some distortion caused by the speaker itself (e.g., its construction and the interaction of the components within it) and by the listening environment (e.g., the location of the listener, the acoustic characteristics of the room, etc) in which the audio signal must travel to reach the listener's ear. This distortion can be represented as shown in FIG. 1A in which the relationship of the input signal to the speaker and the output signal of the speaker is defined by a first transfer function T1 and the relationship of the output signal from the speaker and the signal that reaches the ear of the listener is defined by a second transfer function T2. The first transfer function represents the distortion contributed by the speaker and the second transfer function represents the distortion contributed by the listening environment.

Currently, there are many techniques performed during the manufacture of the speaker to minimize the distortion caused by the speaker itself so as to provide the desired speaker response. FIG. 1B shows a simplified block diagram of a typical speaker 10 which includes a cabinet 11, a cross-over network 12, a set of amplifiers (Amp 13), and a set of transducers 14. An audio input signal is coupled to a cross-over network through a cabinet port. The cross-over network functions to break-up the frequency energy into several high, middle, and low frequency components and divert those frequency components to corresponding amplifiers and transducers. For instance, low-frequency components are coupled to big transducers (also referred to as woofers), the medium frequency components are coupled to the mid-range transducers, and the high frequency components are coupled to the small transducers (also referred to as tweeters). The transducers fit into ports 14 within the cabinet and output an audible analog signal through the ports, often through a mesh screen. Hence, there are four primary independent manufacturing variables (i.e., cabinet, cross-over network, amplifiers, and transducers) that must be dealt with on a speaker-by-speaker (or lot-by-lot) basis to manufacture a reproducible speaker.

Currently, the techniques used to tune a speaker such as shown in FIG. 1B are all mechanical, generally intrusive, and time-intensive since they are often performed by hand. For instance, one manner in which to tune a speaker's response is to adjust potentiometers within the cabinet so as to tune the cross-over network. The cross-over network is tuned to adjust the manner in which the frequency ranges are diverted to each transducer and to reduce the bleeding of frequency ranges into each other. Since these potentiometers often reside within the cabinet, this technique is relatively intrusive requiring hand-tuning while the speaker is disassembled. In addition, components, such a large inductors, within the crossover network might be physically moved to tweak effects caused by magnetic flux.

Another way in which a speaker is tuned is to use holes within the cabinet to modify the resonance of the cabinet by enlarging the holes until the desired resonance is achieved. The bass reflex of the cabinet can also be tuned by placing different length tubes into a passive output port of the cabinet to affect cabinet resonance.

The manner in which speaker users adjust for the distortion caused by the listening environment is to 1) modify the environment to improve its acoustics, 2) manually adjust speaker output characteristics such as treble and bass settings, or 3) move the speaker and the listener with respect to each other to affect the angle(s) in which the audio signal is received by the listener—all of these techniques being an inexact and cumbersome tuning technique.

The present invention is a reproducible, non-intrusive system and method of tuning a speaker which does not require independent physical tuning of each of the physical manufacturing variables of the cabinet or inexact tuning of the listening environment.

SUMMARY OF THE INVENTION

A programmable speaker and a system and method of tuning the speaker uses digital signal processing and stored characterization data to obtain the desired transfer function for the speaker. The programmable speaker includes a programmable portion having a processing portion and a memory portion for storing characterization data. The processing portion receives an input audio signal. The characterization data stored in the memory portion is accessed by the processing portion to perform a transform function on the input signal to generate a transformed signal which compensates for the distortion of the input signal resulting from the physical elements of the speaker and from the listening environment. As a result, each physical speaker element does not require individual tuning and the listening environment need not be altered and instead an overall distortion compensation is achieved by performing the transform function on the input audio signal. The transformed signal is coupled to the output portion of the speaker which produces an audible analog output signal representing the input signal compensated with the transform function according to the characterization data. In one embodiment, the characterization data is the weighting coefficients of the transform function.

A system for tuning the programmable speaker includes a microphone for receiving the audible output signal produced by the speaker and feeding it back to a tuning device. The tuning device includes a reference signal generator for providing a reference signal to the processing portion of the programmable speaker. The tuning device performs a comparison analysis between the audible output signal and the input reference signal and generates a control signal including updated characterization data dependent on the comparison. The control signals are coupled to the programmable input portion of the speaker, are stored in the memory portion, and are used again to tune the speaker by performing the transform function on the input reference signal. The characterization data is used by the processing portion to minimize the distortion by making the input and the output audio signals detected by the microphone as similar as possible. This cycle of providing updated control signals, transforming a reference signal using the updated control signals to generate an output signal, feeding back the output signal, and analyzing the signal to generate a new updated control signal is performed until the reference signal and the signal detected by the microphone match and/or exhibit the desired transfer function relationship.

In one embodiment, the reference signal is chosen so as to tune the speaker to have a given overall operational characteristic such as having a stronger bass (lower frequencies) or alternatively, a strong mid-range (mid-frequencies). In another embodiment, more than one reference signal may be used to tune the speaker to give the speaker a variety of operational characteristics.

In another embodiment, the processing portion performs a cross-over type transfer function so as to generate a plurality of digital signals each corresponding to a different frequency range to be diverted to a different output transducer of the speaker.

In still another embodiment, the processing portion is implemented with a digital signal processing (DSP) unit and an associated DSP memory system. The DSP portion processes the input reference signal according to the characterization data accessed from a non-volatile memory. In another embodiment, the processing portion includes function specific hardware accelerator circuitry to perform mathematical operations used to implement the transform function such as addition and multiplication operations of signals so as to minimize overall processing time of the audio input signal.

In still another embodiment, the output drive portion includes a plurality of digital-to-analog converters for receiving the plurality of transformed signals generated by the cross-over transform function from the programmable portion and for converting them into a plurality of analog signals. The converted signals are coupled to an amplifier stage. The amplified signals are then coupled to the speaker transducers for outputting an audible signal corresponding to the transformed input signal.

In still another embodiment, the speaker is first pre-programmed during a manufacturing tuning process to compensate for distortion caused by the individual speaker elements wherein a set of coefficients are pre-programmed into the memory portion. The pre-programmed speaker is then programmed for a second time by the consumer to tune the speaker to compensate for distortion caused by a specific listening environment. In this embodiment, the second tuning process is implemented by placing the microphone in a selected location within the listening environment. For instance, the microphone may be placed at the location which the listener is to be seated. The tuning portion couples a reference input signal to the speaker and the speaker processing portion transforms the reference signal using the manufacturers pre-programmed coefficients to generate an output reference signal. The microphone receives the output reference signal from the speaker along with distortion resulting from the audio characteristics of the listening environment. The tuning means then adjusts the set of coefficients to compensate for the distortion caused by the listening environment. The reference signal is then again transformed by the processing portion using the set of coefficients adjusted for the particular listening environment. The speaker can perform subsequent tuning cycles until the speaker is tuned to the environment as established by the selected position of the microphone. In accordance with this embodiment, a plurality of sets of coefficients can then be stored in the memory portion—each set corresponding to a different listening environment. In this way the consumer can subsequently retrieve the stored coefficients depending on a desired listening environment.

BRIEF DESCRIPTION OF THE DRAWINGS

The present invention may be further understood from the following written description in conjunction with the appended drawings. In the drawings.

DETAILED DESCRIPTION OF THE PREFERRED EMBODIMENTS

Figure 2:
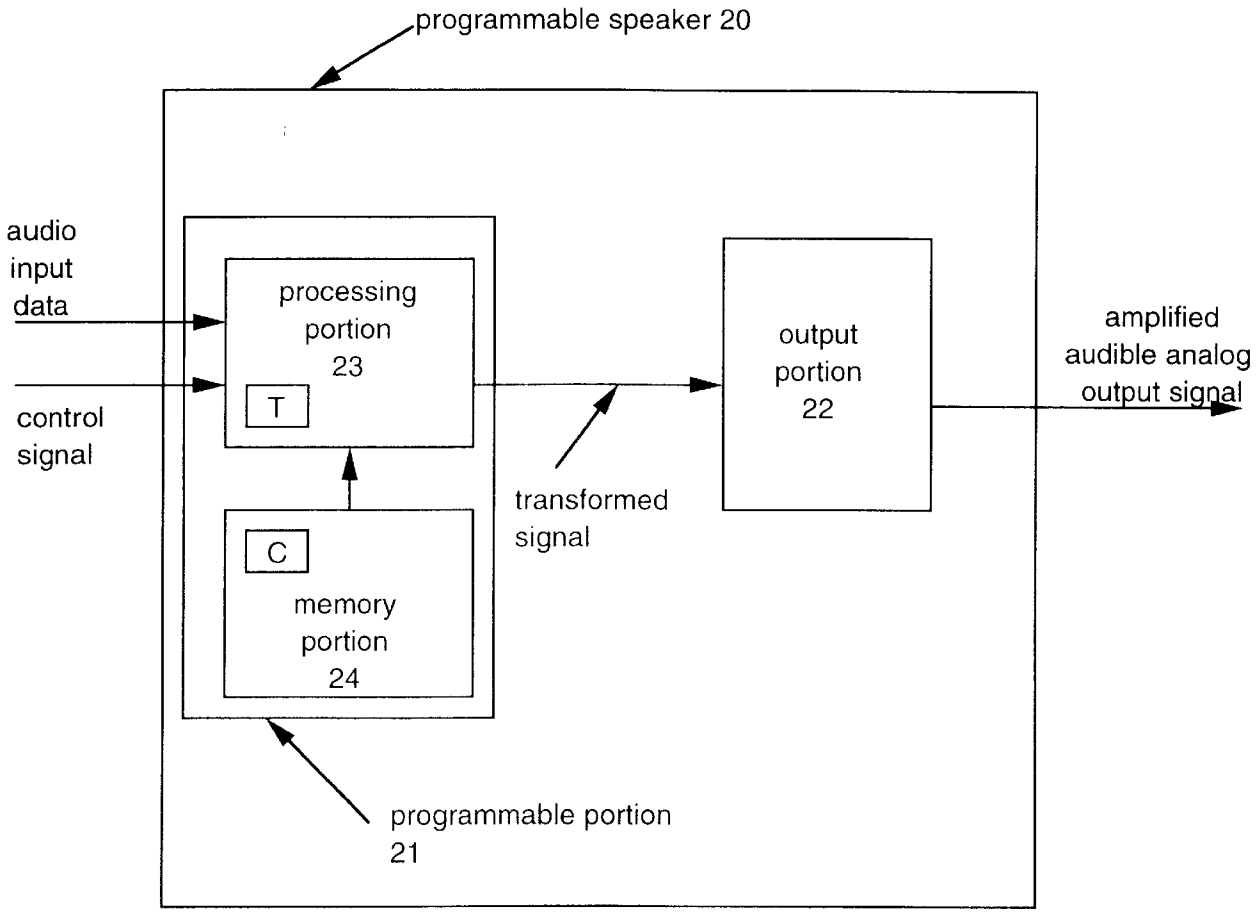
FIG. 2 shows a block diagram of one embodiment of a speaker in accordance with the present invention.

FIG. 2 shows a programmable speaker 20 including a programmable portion 21 and an output portion 22. The programmable portion includes a processing portion 23 and a memory portion 24. The processing portion receives an audio input data (i.e., either an analog signal or a digital data stream) and performs a transform function (T) on the input signal using characterization data (C) stored in the memory portion and outputs a transformed digital output signal according to the transform function and the characterization data. Transform functions are well known in the field of signal processing. The manner in which the transform function is performed on the input signal can include processing signals using function specific hardware, using a generalized microprocessor, and/or using a function specific digital signal processor.

The transformed digital output signal is coupled to the output portion 22 which converts it to an amplified audible analog output signal from the speaker. Hence, the speaker can be programmed to perform a transform function according to the characterization data stored in the memory portion to generate a transformed digital signal. The transform function and characterization data used to perform the transform function represents the inverse transform function which characterizes an overall distortion contributed by a combination of the physical elements of the speaker. Since the transform function performed by the programmable portion 21 represents an overall distortion caused by the elements of the speaker, the individual physical elements do not have to be intrusively and individually tuned and instead the speaker can be tuned by updating the characterization data stored in the memory portion of the speaker. Hence in another embodiment of the present invention, the speaker receives external control signals including new characterization data for programming/tuning the speaker once it is assembled. In accordance with this embodiment, a plurality of speakers which are physically the same (i.e., made up of the same physical elements) can be tuned to sound differently dependent on the characteristic data stored in its memory portion.

Figure 3:
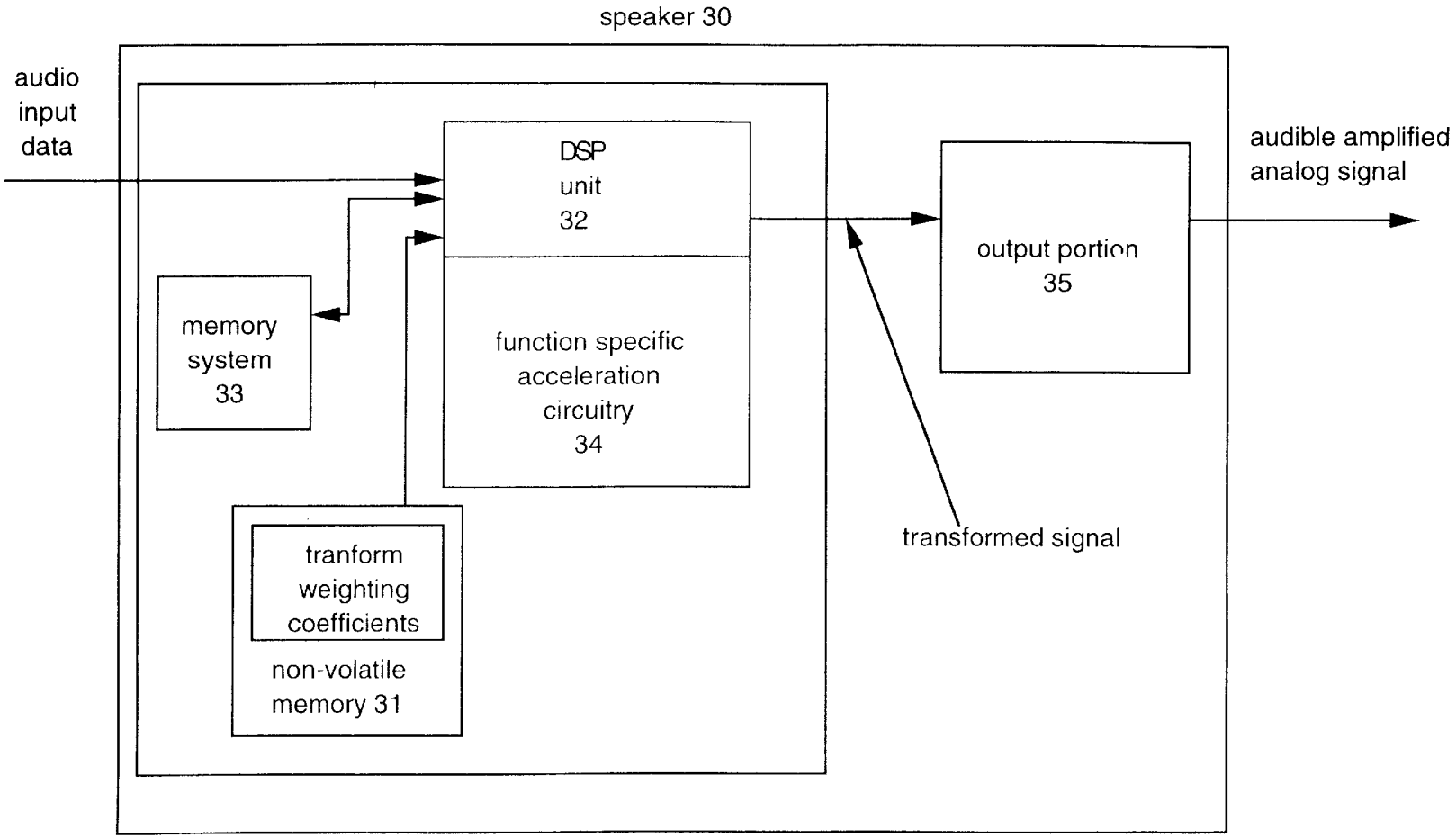
FIG. 3 shows another embodiment of a speaker in accordance with the present invention including a digital signal processor and a non-volatile memory for storing weighting coefficients of a transform function.

FIG. 3 shows a second embodiment of the speaker 30 of the present invention in which the programmable portion comprises a non-volatile memory 31 for storing the characterization data in the form of transform weighting coefficients and comprises a digital signal processing (DSP) unit 32, its associated memory system 33, and optional function specific acceleration circuitry 34. An audio input signal is coupled to the DSP unit and the DSP unit accesses the current weighting coefficients from the non-volatile memory. The DSP unit performs an overall distortion transform function on the input signal using the current weighting coefficients for compensating for the distortion caused by a combination of individual physical elements and their interaction in the speaker. In the embodiment shown in FIG. 3, a single transform function is performed to compensate for a combination of physical elements to generate a transformed audio signal which is coupled to the output portion 35 to generate an undistorted audible, amplified analog output signal.

In another embodiment, the speaker includes a processing portion which performs more than one transform function to compensate for different types of distortion. For instance, in the embodiment of the speaker 40 shown in FIG. 4 including a processing portion 41, a memory portion 42 and an output portion 43, a first transform function (Ti) is performed using a first set of coefficients (C1) for compensating for a combination of physical elements in the speaker and a second cross-over type transform function (T2) is performed using a second set of coefficients (C2) for compensating for the speaker cross-over network distortion. In general, the cross-over type transform function performs a similar function as a conventional cross-over network in a speaker in that it divides the input signal into a plurality of signals having different frequency ranges. In addition, the cross-over type transform function compensates for distortion affects caused by other elements in the speaker which affect the cross-over function of the speaker. The result of the second cross-over type transform function is a plurality of distortion compensated transformed digital signals 44 each associated with a different frequency range and coupled to the output portion 43. In this embodiment, the output portion is embodied to include a digital-to-analog (D-to-A) signal converter stage 45 coupled to each of the plurality of transformed digital signals. Each D-to-A converter is coupled to an amplification stage 46. Each Amp outputs an amplified analog signal to a transducer 48 adapted for the frequency range of signal coupled to it. For instance, one transducer may be characterized in that it is adapted to receive lower frequency signals whereas another transducer may be characterized to receive higher frequency signals. The transducers then output an audible analog output signal which is distortion compensated. It should be understood that the speaker may include other elements not within the scope of the present invention. For instance, the output portion may include radiated EMI filters for regulatory compliance.

In one embodiment, a method of tuning the speaker shown in FIG. 2 is performed by programming a memory portion in the speaker with characterization data, using the characterization data to perform a transform function on an input audio signal to generate a transformed signal in which the transform function represents the inverse transform function of an overall distortion caused by a combination of physical speaker elements, coupling the transformed signal to a speaker output stage, converting the transformed signal to an amplified analog audible signal, and outputting said audible signal from the speaker. In the case of tuning the speaker shown in FIG. 3, the characterization data is the weighting coefficients of the transform function. In the case of tuning a speaker shown in FIG. 4, more than one set of weighting coefficients are programmed into the speaker memory.

Figure 4:
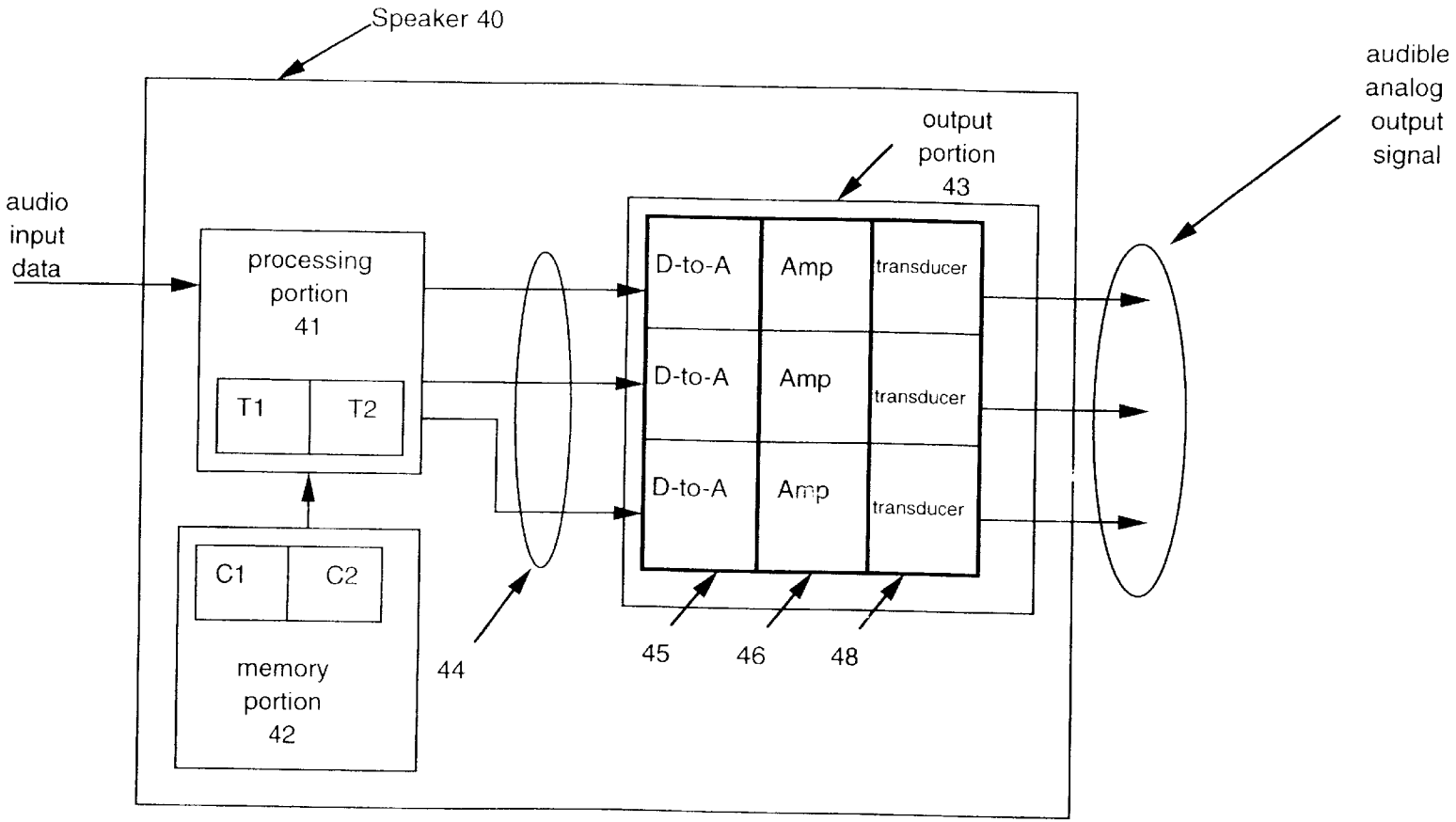
FIG. 4 shows another embodiment of a speaker in accordance with the present invention in which more than one transform function is performed.
Figure 5:
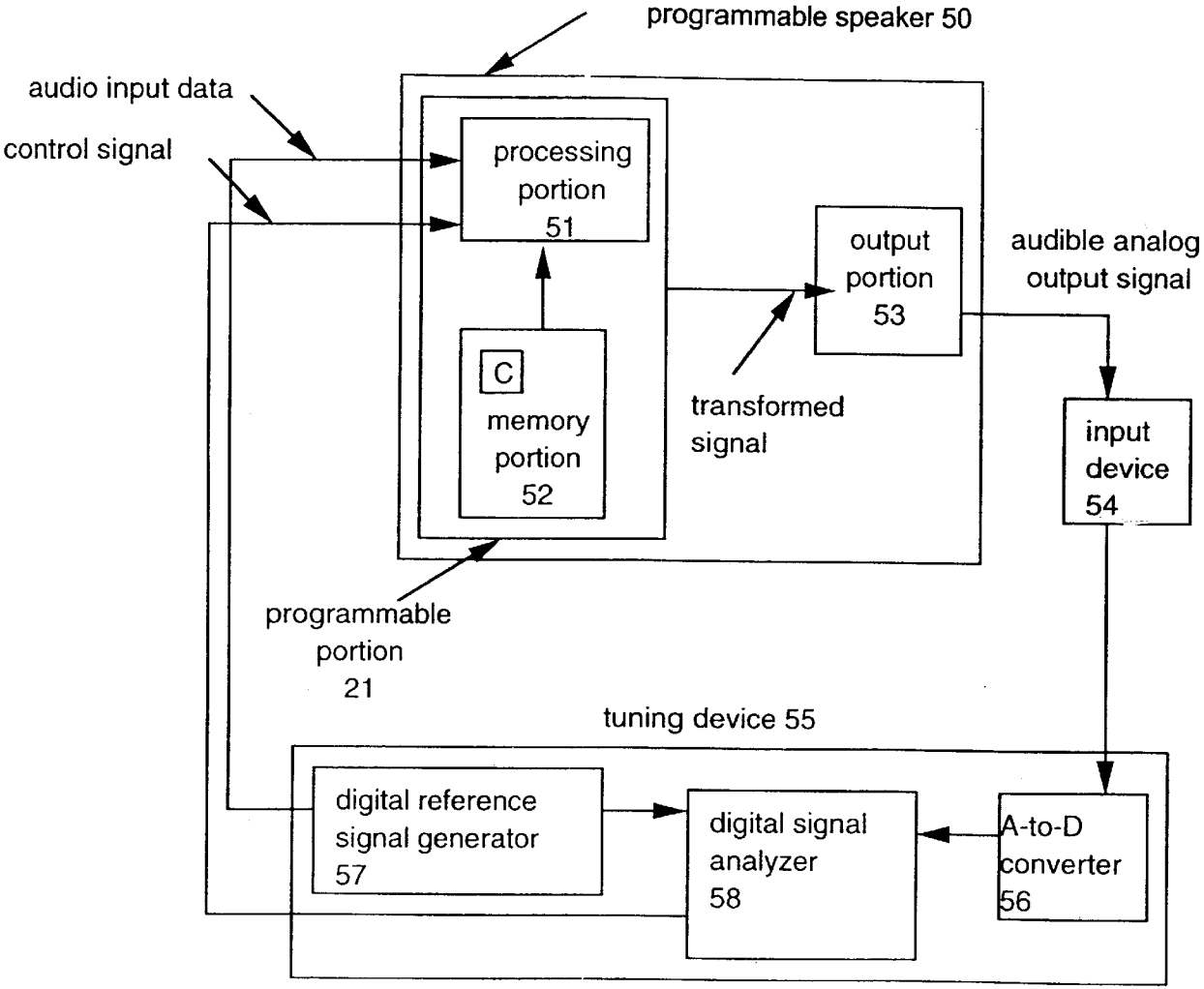
FIG. 5 shows a block diagram of a system for tuning a programmable speaker according to the present invention.

One embodiment of a system for tuning a programmable speaker as shown in FIGS. 2–4 is shown in FIG. 5 which includes a programmable speaker 50 including a processing portion 51, a memory portion 52 for storing characterization data, and an output portion 53. The processing portion 51 receives an input audio signal and an input control signal which includes characterization data. The processing portion 51 stores in the memory portion 52 updated characterization data (C) received in the control signal. In addition, the processing portion accesses the updated characterization data and uses it to perform its corresponding transform function to generate a transformed signal as described above. The transformed signal is coupled to the output portion 53 which generates a corresponding audible analog output signal.

The system for tuning a programmable speaker further includes an audio signal input device 54 for receiving the audible analog output signal from the speaker 50 and for providing a corresponding analog signal to a tuning device 55. The tuning device includes an analog-to-digital converting means 56 for converting the analog output signal from the speaker to a digital feedback signal. The tuning device 55 further includes a means for generating at least one digital reference audio signal 57 for coupling to the first input port of the speaker and a digital signal analysis means 58 for comparing the digital reference signal coupled to the input of the speaker to the digital feedback signal and, in response to the comparison, generating a control signal including updated characterization data. The updated comparison data is stored in the memory portion by the processing portion. The processing portion accesses the updated characterization data to perform its corresponding transform function(s). The updated characterization data causes the transform function to be adjusted so as to tune the speaker to output an audible signal which has essentially the same the frequency, amplitude and phase response characteristics of the input reference signal. The output signal is again fed back and if the feedback signal is still different than the reference signal, the characterization data is updated and provided to the speaker and the transform function is performed with updated characterization data to generate a new output feedback signal until the output audible signal has essentially the same the frequency, amplitude and phase response characteristics as the reference signal. Once the input reference and output signals match, the last characterization data stored in the memory portion is used to perform the transform function on any audio input signals which pass through the speaker until it is tuned again.

In one embodiment, the analysis means includes a means for identifying the differences between the feedback signal and reference signal and selecting an appropriate digital reference signal dependent on the identified differences. For instance, if the analysis means identifies that a given frequency range difference or amplitude difference is occurring, a specific digital reference signal may be selected to try to compensate for distortion which may be causing this type of difference.

In another embodiment, digital reference signals may be selected dependent on the type of sound that the speaker is to be used to play. For instance, audio signals of women vocalist tend to be primarily made up of high frequency elements. Hence, a speaker being tuned using the system as described in FIG. 5 may use a digital reference signal that is primarily high frequency components if the speaker is to be used to primarily play women vocalist's music. In contrast, a speaker used to play jazz or male vocalist music may be tuned using a different digital reference signal. Hence, the means for generating a digital reference signal may include a library of reference signals which can be selected by a user or technician to tune a speaker. In accordance with this embodiment, a plurality of speakers which are physically the same (i.e., made up of the same physical elements) can be specifically tuned to sound differently dependent on the characteristic data stored in its memory portion.

In accordance with another embodiment of the present invention, a plurality of speakers are tuned in a manufacturing environment in which a current speaker in an assembly line is tuned using characteristic data or transform coefficients which are determined from the previous speaker in the assembly line such that the tuning system can "learn" from previous tuning procedures to minimize the number of feedback loops required to tune each speaker. For instance, if a previous speaker is tuned in accordance with the feedback technique as described above and final characteristic data is determined, the determined characteristic data is "remembered" by the tuning system and then provided to the next speaker via a control signal coupled to the second port of the next speaker. By loading in an expected set of characteristic data, the next speaker may not require as many reiterative adjustments to the characteristic data for tuning.

Figure 1A:
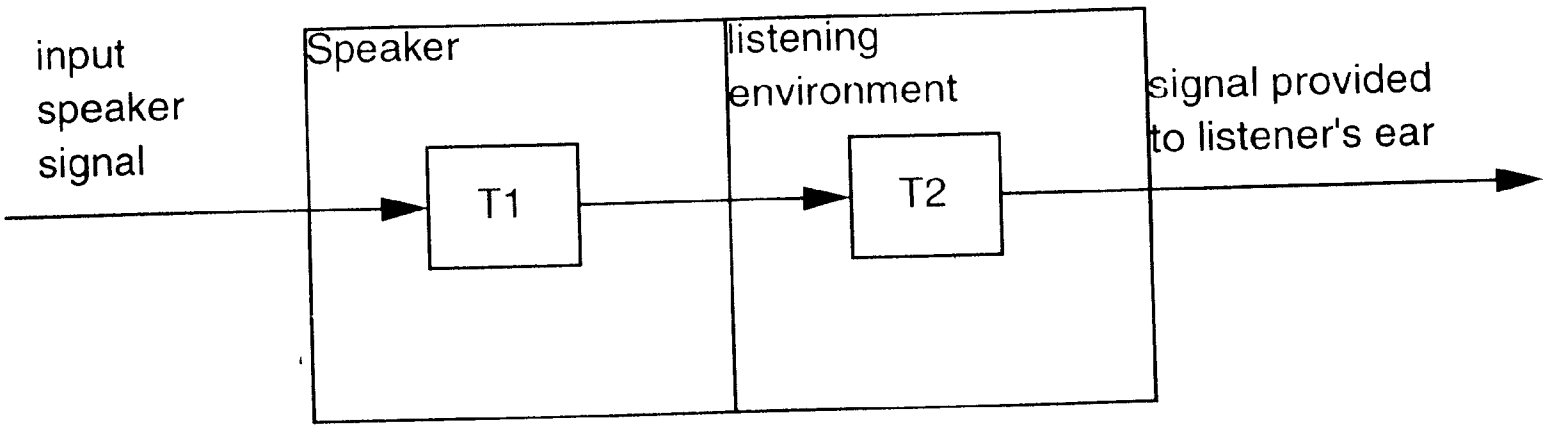
Figure 1A PRIOR ART
FIG. 1A shows a distortion model of a signal traveling from the input of a speaker to the input of a listener's ear.
Figure 1B:
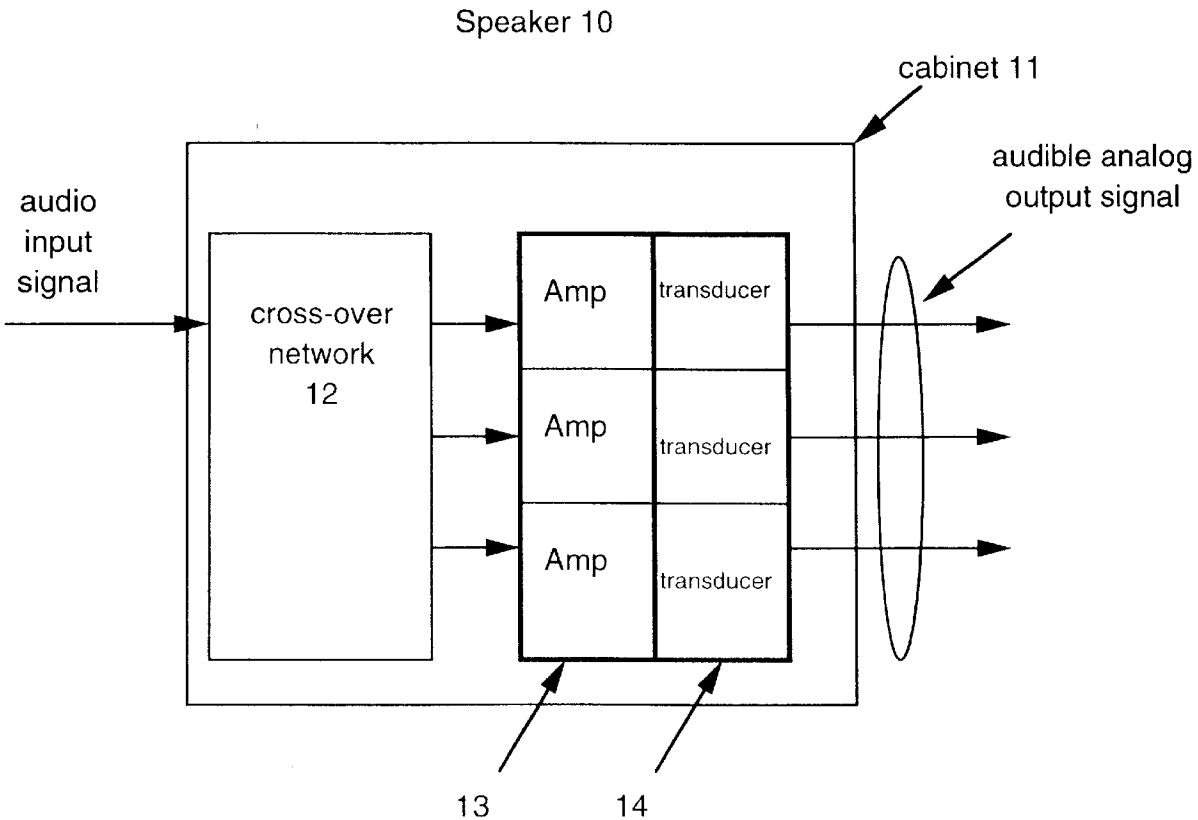
Figure 1B PRIOR ART
FIG. 1B shows a prior art simplified block diagram of a speaker.

In the embodiments of the programmable speaker shown in FIGS. 2–5, the speaker is tuned to minimize or eliminate distortion affects associated with the speaker such as the speaker elements and interaction between these elements. Referring to FIG. 1A this distortion is represented by the transfer function T1. In accordance with another embodiment of the programmable speaker of the present invention, the speaker may also be programmed to minimize or eliminate distortion affects caused by the listening environment. Referring to FIG. 1A this distortion is represented by the transfer function T2. Specifically, when an audio signal leaves the speaker it may hit obstacles or bounce off walls within the listening environment before it reaches the listener's ear. Alternatively, the acoustic characteristics of each listening environment might be different. For instance the size of a room would affect the acoustic characteristics of a room. In general, the actual audio signal received by the ear is a distorted signal composed of the same signal coming from various different angles within the listening environment in addition to any ambient sounds within the environment.

Hence in accordance with one embodiment of the programmable speaker of the present invention the speaker shown in FIG. 2 includes a processing portion 23 which performs a transfer function T on an audio input signal using characterization data C. The transfer function T is the inverse transfer function of a combination of or the product of two transfer functions T1 and T2 where T1 corresponds to the distortion caused by the speaker and T2 corresponds to the distortion caused by the listening environment (as shown in FIG. 1A). The characterization data C is used by the processing portion when performing the transform function on the audio input signal to compensate for both the speaker related and listening environment related distortion.

Figure 6:
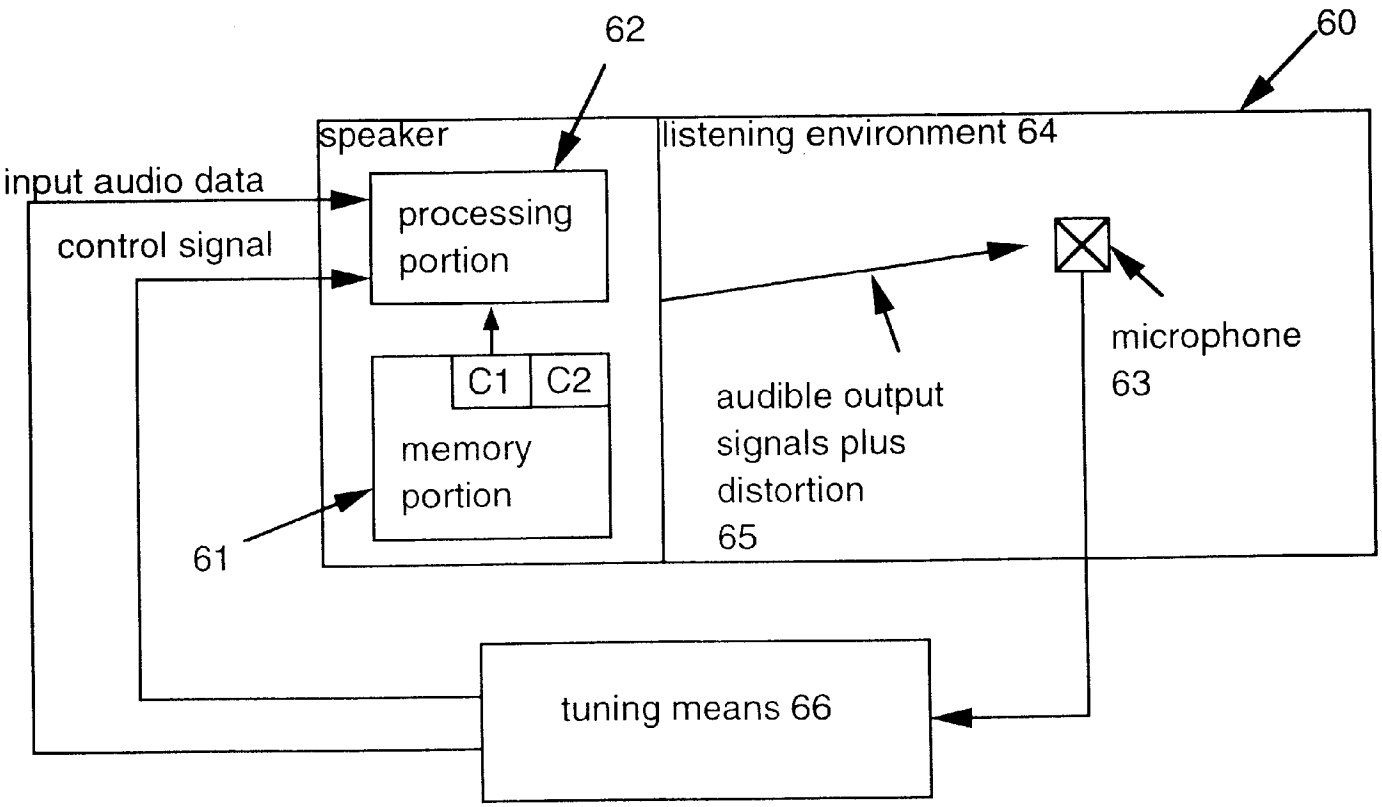
FIG. 6 shows a block diagram of a system for tuning a programmable speaker dependent on the speaker listening environment.

In accordance with another system and method of the present invention, the programmable speaker can be tuned to minimize or eliminate distortion caused by the listening environment. FIG. 6 shows the programmable speaker 60 of the present invention and a system for tuning the speaker. During the manufacturing process, the speaker is pre-programmed with weighting coefficients C1 and stored in memory portion 61. The coefficients C1 are used by the processing portion 62 to perform a transform function T on the input signal to generate an audible output signal in which distortion affects related to the speaker are minimized or eliminated as described in conjunction with FIG. 5. In the consumer environment, the tuning system includes a microphone 63 for detecting the audible signal from the speaker within the listening environment 64 of the speaker. In one embodiment, the microphone can be placed in the location at which the user will be positioned when listening to the speaker. The microphone receives the output signal 65 from the speaker along with any distortion caused within the listening environment. The microphone feeds the received signal back and a tuning means 66 adjusts the coefficients C1 to generate a new set of coefficients C2 which compensate for distortion affects within the current listening environment. The new set of coefficients C2 are then used by the processing portion when transforming the input audio signal. The tuning cycle can be performed again until the input audio signal essentially matches or has a selected transfer function relationship with the signal that is received by the microphone. In this embodiment, the original set of coefficients and the new set of coefficients can be stored in memory portion 61. It should be noted that the microphone and tuning means can be implemented as separate system components as shown in FIG. 6 or can be implemented such that the tuning means is incorporated within the speaker.

In accordance with this embodiment, the programmable speaker can be tuned so as to have stored in its memory portion a plurality of sets of coefficients —each corresponding to a different listening environment and each being stored in the memory portion. In this way when the consumer desires to use the speaker in a selected listening environment, the stored set of coefficients corresponding to that environment can be accessed from the memory portion by the processing portion and used to perform the transform function on the input signal to generate a compensated environment specific output signal from the speaker.

Alternatively, the speaker may be pre-programmed or pre-loaded by the manufacturer with sets (or templates) of coefficients—each corresponding to a different type of listening environment. For instance one template may correspond to a concert hall environment, whereas another might correspond to a home theater environment.

In still another embodiment, the listening environments acoustic characteristics are continuously monitored and the characteristic data is continuously updated to account for changes within the listening environment such as ambient sound levels.

It should be noted that in the embodiment of the programmable speaker shown in FIG. 6, and the system and method of programming this speaker can also be implemented such that the speaker is pre-tuned in the manufacturing environment in accordance with prior art methods to minimize or eliminate distortion caused by the speaker elements and the speaker is subsequently tuned in the consumer environment to minimize or eliminate distortion caused by the listening environment using the system as shown in FIG. 6. In this case, default characterization data is stored in the non-volatile memory which may be representative of typical listening environment(s). The transform function performed by the processing portion can then use the default characterization data to tune the speaker to the selected listening environment.

In the preceding description, numerous specific details are set forth in order to provide a thorough understanding of the present invention. It will be apparent, however, to one skilled in the art that these specific details need not be employed to practice the present invention. In other instances, well known speaker structures and components have not been described in order to avoid unnecessarily obscuring the present invention.

Moreover, although the components of the present invention have been described in conjunction with certain embodiments, it is appreciated that the invention can be implemented in a variety of other ways. Consequently, it is to be understood that the particular embodiments shown and described by way of illustration is in no way intended to be considered limiting. Reference to the details of these embodiments is not intended to limit the scope of the claims which themselves recite only those features regarded as essential to the invention.

What is claimed is:

1. A programmable speaker, comprising:

a programmable portion including a processing portion and a memory storage area for storing characterization data, said processing portion for performing a transform function on an input audio signal using said characterization data, said programmable portion receiving and processing said audio input signal and outputting a transformed signal wherein said transform function corresponds to the inverse transform function of the product of a first transform function corresponding to speaker related distortion and a second transform function corresponding to listening environment distortion; and an output portion for converting said transformed signal into an audible analog signal.

2. The speaker as described in claim 1 wherein said characterization data comprises sets of characterization data each corresponding to a different selected listening environment wherein one set is used when performing said transform function dependent on said selected listening environment.

3. The speaker as described in claim 1 wherein said programmable portion includes a means for receiving said characterization data from an external source and storing said received characterization data in said memory storage area.

4. The speaker as described in claim 1 wherein said processing portion comprises a digital signal processing unit, its corresponding memory system, and function specific hardware for performing said transform function on said input signal using said characterization data to generate said transformed signal.

5. The speaker as described in claim 1 wherein said memory storage area is a non-volatile memory.

6. The speaker as described in claim 1 wherein more than one transform function is performed on said input signal by said processing portion each transform function using different characteristic data.

7. The speaker as described in claim 1 wherein said characterization data is weighting coefficient values of said transform function.

8. A speaker system, comprising:

a speaker disposed in a speaker enclosure;

a processing portion, coupled to the speaker, and disposed in the speaker enclosure;

a first stored set of weighting coefficients, coupled to the processing portion, for providing control information to the processing portion to compensate for speaker related distortion;

a microphone disposed in a listening environment; and a tuning means coupled to the microphone, and further coupled to the processing portion, the tuning means adapted to provide, based at least in part upon the first stored set of weighting coefficients and a signal received from the microphone, a second stored set of weighting coefficients, the second stored set of weighting coefficients for providing control information to the processing portion to compensate for both speaker related distortion and listening environment distortion.

9. The speaker system of claim 8, wherein the first set of weighting coefficients is based, at least in part, upon a comparison of a reference input signal, to an audio output signal produced by the speaker system in response to receiving the reference input signal.

* * * * *